United States Patent [19]

Moreau

[11] Patent Number: 4,693,911

[45] Date of Patent: Sep. 15, 1987

[54] METHOD FOR LINING A BASE WITH A CONTINUOUS GRANULATE LAYER AND EQUIPMENT FOR THE WORKING OF THIS METHOD

[75] Inventor: Jean-Frédéric Moreau, Carces, France

[73] Assignee: Revetements De Couvin, Couvin, Belgium

[21] Appl. No.: 846,739

[22] Filed: Apr. 1, 1986

[30] Foreign Application Priority Data

Apr. 3, 1985 [BE] Belgium ..... PV 0/214780

[51] Int. Cl.[4] ..... B05D 1/02

[52] U.S. Cl. ..... 427/196; 427/203; 427/204; 427/205; 118/308; 118/303; 118/629

[58] Field of Search ..... 427/196, 203, 204, 205, 427/186; 118/308, 303, 629, 638

[56] References Cited

U.S. PATENT DOCUMENTS 2,313,082 3/1943 MacDonald ..... 427/196 X
2,707,690 5/1955 Pearson ..... 118/303 X
2,707,847 5/1955 Anliker ..... 118/303 X
4,243,696 1/1981 Toth ..... 118/308 X
4,478,896 10/1984 Barnes et al. ..... 427/196 X

FOREIGN PATENT DOCUMENTS 431519 1/1963 Japan ..... 118/303

*Primary Examiner*—Shrive P. Beck
*Attorney, Agent, or Firm*—Cushman, Darby & Cushman

[57] ABSTRACT

There is described a method for lining the one surface from a base with a continuous granulate layer, which comprises, relieving the granulates from foreign materials, raising said granulates to a higher level than said base, spreading said granulates to form said layer, coating the granulates during the fall thereof with a material causing same to adhere to said base, moving the fall location relative to said base along a direction in parallel relationship with the one base side, at a pre-determined speed, and letting said material coating the granulates laid down on the base, harden.

27 Claims, 7 Drawing Figures

METHOD FOR LINING A BASE WITH A CONTINUOUS GRANULATE LAYER AND EQUIPMENT FOR THE WORKING OF THIS METHOD

This invention has for object a method for lining a substantially plane quadrilateral-shaped side from a base, with a continuous granulate layer.

The present methods essentially comprise either coating the base side to be lined with the granulate layer, with a material which causes said granulates to adhere to the base, laying the granulate layer in natural condition over the coated base side, coating with said material the top surface of that granulate layer laid on the base, and hardening said material, or mixing the granulates and said material at the time of use, and spreading said mixture over the base with a trowel or hawk.

Such methods have the following main drawbacks: bad embedding of all the granulates forming that layer which is laid over the base, and thus inadequate securing thereon of said granulates, requirement to use to obtain such bad embedding, too large an amount of said material, which is notably harmful to the end product appearance and makes such methods particularly expensive.

The invention has for object to obviate such drawbacks and to provide a method allowing to coat with said material each granulate comprising the layer to be laid over the base to obtain a faultless grip of the granulates thereon, and this while using a small amount of said material, which allows to retain for the granulates the natural appearance thereof, said method having the further advantage of enabling a high production throughout.

For this purpose according to the invention, the granulates are relieved from foreign materials, said granulates are brought to a higher level than the base, the granulate flow rate is adjusted, the granulates are spread to form said layer, said layer is moved by gravity towards the base, the granulates forming the layer are coated during the layer fall with a material which causes said granulates to adhere to the base, the layer fall location is moved relative to the base along a direction in parallel relationship with the one base side, the relative movement speed in said location is adjusted, and the material coating the granulates laid over the base is left to harden.

In an advantageous embodiment of the invention, the granulates are washed to relieve same from foreign materials, and the granulates are retained in the required moist condition up to that time where they are coated with said material.

In an advantageous way to embody the invention, the granulate layer laid over the base is coated with said material in a location near that location where said layer falls, as well as the base side to be lined is coated in a location near said layer fall location.

In a particularly advantageous embodiment of the invention, the granulates and said material are electrically charged with opposite polarities.

The invention has also for object an equipment for the working of said method.

According to the invention, such an equipment notably comprises means for relieving the granulates from foreign materials, means to raise said granulates to a higher level than the quadrilateral-shaped base, means to adjust the granulate flow rate, means to spread said granulates and form therewith a continuous layer which is laid by gravity over said base, means to coat the granulates in said layer during the fall thereof, with said material for adhering the granulates to the base, means to move the layer fall location relative to the base along a direction in parallel relationship with the one base side, and means to adjust the relative movement speed of said location.

The invention further relates to a base lined with a granulate layer by means of said method, and obtained with said equipment.

Other details and features of the invention will stand out from the following description, given by way of non limitative example and with reference to the accompanying drawings, in which.

In the various figures, the same reference numerals pertain to identical or similar elements.

Figure 1:
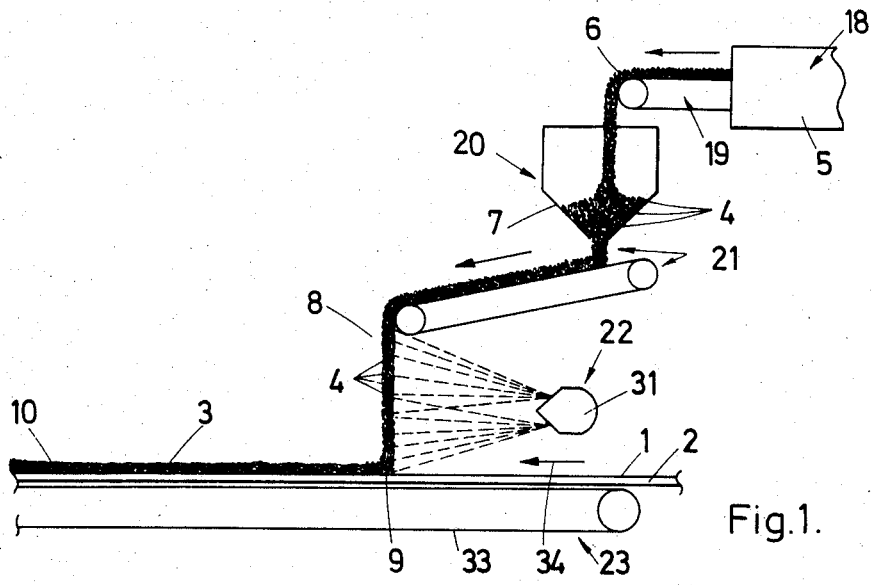
FIG. 1 is a diagrammatic elevation view showing said method and an equipment in the most simple form thereof, for the working of said method.

The method according to the invention is intended for the lining of one surface or side 1, in the shape of substantially plane quadrilateral, from a base 2, with a continuous layer 3 from granulates 4. According to such method and as shown in FIG. 1, the granulates are relieved in 5 from foreign materials, said granulates are brought to a higher level 6 than base 2, the granulate flow rate is adjusted in 7, the granulates are spread to form said layer 3, said latter layer is moved by gravity in 8 towards the base, the granulates 4 forming said layer are coated during the layer fall, with a material which can cause said granulates to adhere to the base, the layer fall location 9 is moved relative to the base 2 along a direction in parallel relationship with the one base side, the relative movement speed of said location 9 is adjusted, and said material coating the granulates laid over the base, is left to harden in 10.

To give a shiny apperance to the granulates 4 when same are coated with said material, as well as to enhance the adherence of said material comprised of a water dispersion of a plasticizer-free acrylic polymer, to the granulates, said granulates 4 are washed in 5 to relieve same from foreign materials, and said granulates are retained in the required moist condition up to that time where the granulates are coated with said material.

To improve the grip of granulates 4 on base surface 1, said base surface 1 to be lined is advantageously coated with said material in a location 11 (FIG. 2) near the layer fall location 9. To improve the cohesion of those granulates lying on the visible surface 12 of layer 3, said surface is advantageously coated with said material, in a location 13 next to the fall location 9 (FIG. 3).

Figure 2:
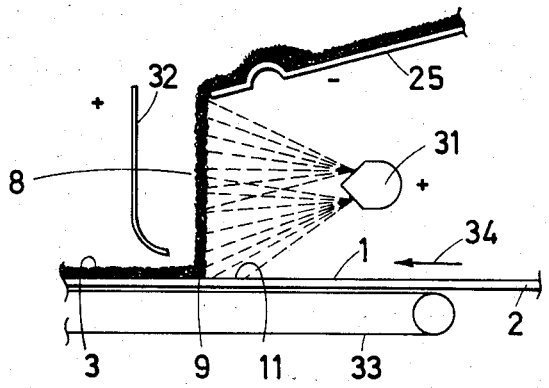
FIGS. 2 to 6 are views similar to FIG. 1 and showing variations of the equipment as shown in FIG. 1.
Figure 3:
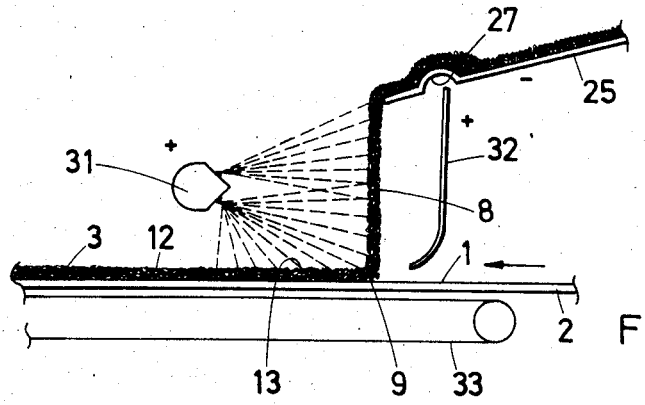

As shown in FIGS. 2 and 3, provision is made according to the invention and to improve the coating of granulates 4 with said material in zone 8 where the layer moves by gravity, to electrically charge with opposite polarities, the granulates 4 and the material, keeping the granulates in moist condition making the current flow easier through the granulate layer.

To speed up the hardening of said material as a result of evaporating the water from the water emulsion comprising said latter material, there is advantageously spread in 14 (FIG. 5) over base surface 1 to be lined, a substance such as lime, which can absorb water, such spreading occuring on said surface 1 before same engages the water emulsion.

Figure 6:
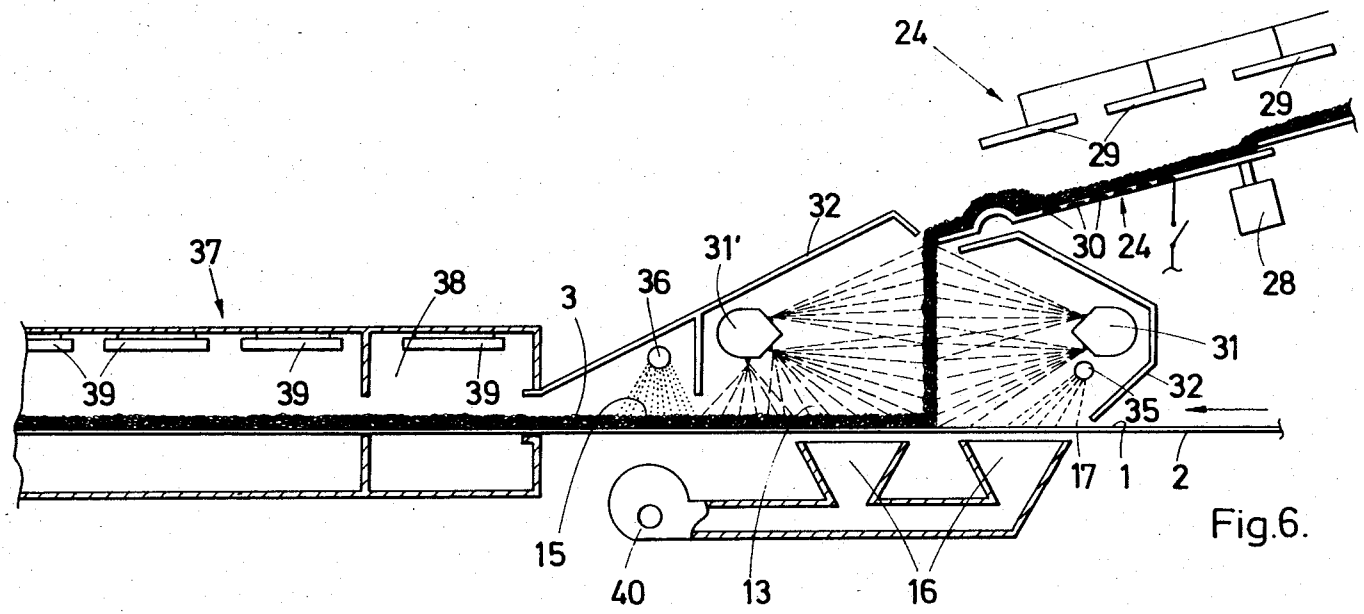

To obtain smoothing of the coated granulates, after said layer 3 has been laid over the base, a finishing product such as steam, is advantageously projected in 15, as shown in FIG. 6, over the granulate layer 3 laid over base 2, such projection occuring outside that zone 13 where the granulates are coated with said material. The steam-projection station 15 is of course so selected as to have the steam reach the granulate layer before the material starts to harden.

When said base 2 is pervious to said material, that surface 17 from base 2 opposite to that surface 1 receiving the granulate, is advantageously heated in 16 as shown in figure 6, such heating being performed in that area of said base which is coated with said material in unhardened condition.

The equipment according to the invention for the working of said method, comprises as shown in FIG. 1, means 18 for relieving the granulates 4 from foreign materials, means 19 to raise said granulates to a higher level than the quadrilateral-shaped base, means 20 to adjust the granulate flow rate, means 21 to spread same and form a continous layer 3 laid by gravity over said base 2, means 22 to coat the granulates in said layer, as they fall down in 8, with that material to adhere said granulates to the base, means 23 to move the fall location 9 of layer 3 relative to base 1 along a direction in parallel relationship with the one base side, and means not shown to adjust the movement speed of said location 9, heating means being advantageously arranged as shown in figure 6, to speed-up the hardening of said material coating those granulates which comprise the layer 3 as laid over base 2.

As shown in FIG. 6, the means 18 to relieve the granulates from foreign materials advantageously comprise a washing enclosure at the outlet wherefrom heaters 24 are arranged to dry partly at least, the granulates.

As shown in FIGS. 2 to 6, the means 20 to adjust the granulate flow rate, and the means 21 to spread same and form therefrom a continous layer, comprise on the one hand a slanting table 25 on the top surface of which the granulates 4 move by gravity, which table has in parallel relationship with the lower edge 26 thereof, over the whole length thereof and adjacent thereto, an element 27 projecting relative to said top surface, the cross-section of which is substantially of half-circle shape, and on the other hand a vibration generator 28 connected to table 25, means not shown being provided on the one hand to vary the table slanting angle, and on the other hand to change the frequency and amplitude of the vibrations generated by generator 28.

The heating means 24 for drying partly at least the granulates 4, are advantageously comprised as shown in FIG. 6, on the one hand of banks 29 so designed as to radiate an infrared radiation in the direction of the top surface of slanting table 25, and on the other hand of resistors 30 associated to the top surface of said table.

As shown in FIG. 1, the means 22 to coat with said material the granulates 4 in said layer, may be comprised of a single bank of nozzles 31 in parallel relationship with base 2 and layer 3, in 8, and the length of which is substantially equal to that dimension of layer 3 as considered in parallel relationship with bank 31, the nozzles being so directed as to spread said material to coat the granulates 4 in said layer, in said zone 8.

As shown in FIG. 2, the nozzle bank 31 lies between table 25 and base 2, the nozzles being moreover so directed as to spread in 11, said material over base surface 1 to be lined, in a location next to the fall location 9 of said layer 3.

As shown in FIG. 3, the single nozzle bank 31 may also be arranged above the base coated with granulate layer 3, the nozzles being so directed as to spread the material in zone 8, and in 13 over the granulate layer as laid over the base, in a location next to the location 9 where said layer falls on said base.

Coating the granulate with that material which causes same to adhere to the base may be enhanced by mounting the nozzles on a device, not shown, which is so arranged as to move said nozzles alternately between table 25 and base 2, along a direction substantially at right angle to said latter base.

To avoid in the embodiments of the invention as shown in FIGS. 2 and 3, dispersing in the atmosphere said material beyond zone 8 of granulate layer 3, a fixed baffle 32 is provided opposite the nozzle bank 31 relative to that granulate layer moving from table 25 to base 2.

To maximize coating the granulates 4 with the material, the equipment comprises a high-voltage source not shown, the one source pole being connected to table 25, while the other pole is connected to nozzle bank 31. In that case where a baffle 32 is being provided, said baffle is also connected to that same source pole as bank 31, in such a way as to have the material moving towards the baffle be repelled and fall either on base surface 1 (FIG. 3), or on the granulate layer 3 which has already been laid down on the base (FIG. 2).

As shown in FIGS. 1 to 5, said equipment means 23 are comprised of an endless conveying belt 33 carrying the base along a direction 34 at right angle to the granulate layer 3 moving by gravity in 8 towards base 2.

Figure 4:
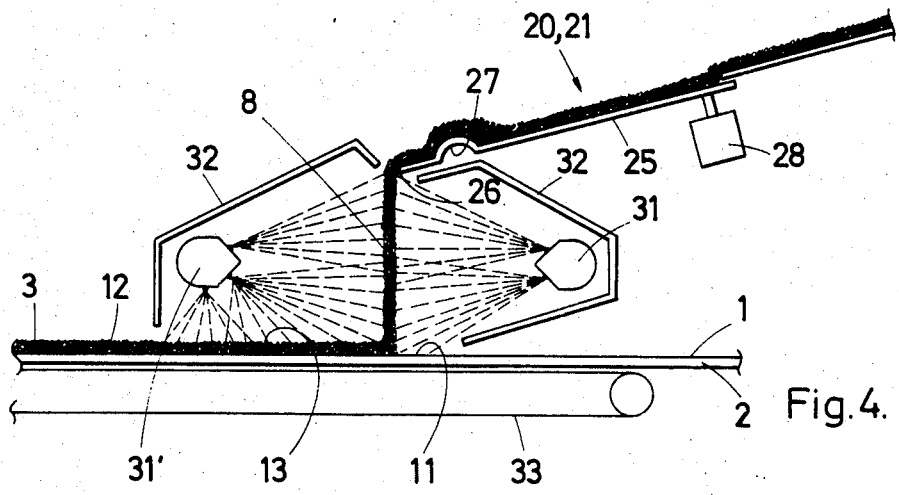
Figure 5:
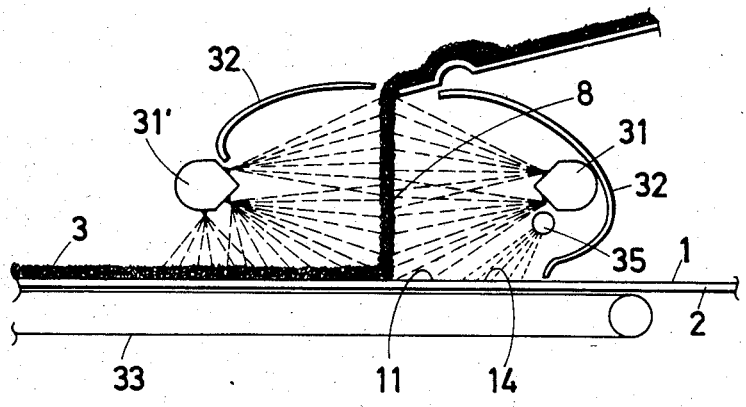

The equipment according to the invention may further comprise as shown in FIGS. 4 to 6, two nozzle banks 31, 31', arranged in parallel relationship with the lower edge 26 of table 25, and the length of which substantially corresponds to the layer dimension as considered in parallel relationship with said edge, said banks 31, 31' being arranged on either side of the granulate layer 3 moving in 8 from table 25 to base 2, each said banks lying between said granulate layer 3 and a fixed baffle 32, advantageously charged with the same polarity as the nozzles. Said baffles 32 are advantageously so shaped as shown in FIG. 5, as to return said material moving near said bâffles 32, on the one hand in the material flow originating from the nozzles, and on the other hand over surface 1 from base 2. The baffles 32 being used preferably enclose substantially tightly the zone or zones of material diffusion, to prevent said material spreading in the atmosphere.

As shown notably in FIG. 6, the equipment comprises with an arrangement in parallel relationship with said nozzle bank 31, means 35 for distributing a product able to speed-up hardening of said material, said means being so arranged as to load with said product surface 1 from base 2 to be lined, before said surface does engage said material.

Said equipment comprises at least one distributor 36 fed with steam, lying in parallel relationship with banks 31, 31', the nozzles from said steam distributor 36 being so arranged as to distribute the steam over the granulate layer 3 lying on base 2, upstream of that zone 13 where said material is spread over the granulates and this for smoothing said material before hardening thereof.

Said hardening may be speeded-up by means of an oven 37 (FIG. 6) which comprises a pre-heating chamber 38 to prevent any heat shock, said chamber and oven being advantageously heated by means of infrared radiators 39.

In that case where base 2 is pervious to said material, the equipment comprises as shown in FIG. 6, a blower 40 blowing hot air over that base surface opposite to base surface 1, in those areas 16 where the base contacts unhardened material, so as to speed-up the hardening thereof to avoid said material flowing away by gravity from the base.

It must be understood that the invention is in no way limited to the above embodiments and that many changes may be brought thereto without departing from the scope of the invention as defined by the appended claims.

Figure 7:
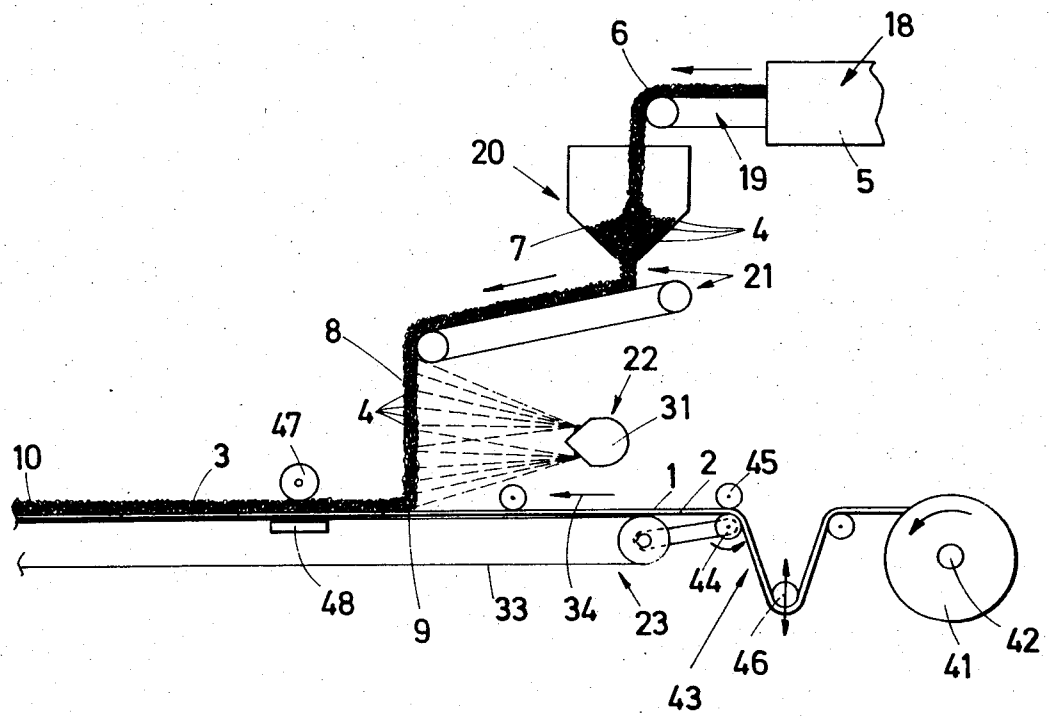

For instance, as shown in FIG. 7, the means 23 for conveying base 2 from a roll 41 of said base, might advantageously be comprised of a driving shaft 42 whereon said roll is mounted, an endless mesh band 33, wherethrough hot air may be blown onto that base surface opposite to the surface which will receive the granulate layer 3, which moves the base to line same with granulates, and a storage device 43 arranged between roll 41 and the endless band 33. Said device 43 can store some length of the unrolled base resulting from differences between the constant linear speed of the endless band, and the varying unwinding speed of the roll, and it comprises on the one hand a set of two rollers 44 and 45, wherebetween the base runs, located upstream of the endless band and with roller 44 thereof being so driven by the band as to have the linear speed thereof equal to the linear speed of said band, and on the other hand at least one movable roller 46 which retains the unwound length between the roller set and the roll.

To pre-coat the base 2 with said material or with a product speeding-up the hardening of said material, use may be made of a roller arranged upstream of that location 9 where layer 3 is being applied, which distributes said material over the blank base.

To level the granulate layer 3 and lay said granulates down on the base, there is advantageously provided a cylinder 47 which is so arranged as to bear on the layer after laying same on the base, and possibly a vibrating table 48 arranged underneath the top run of endless band 33 facing cylinder 47.

I claim:

1. Method for lining a substantially plane quadrilateral-shaped surface of a base, with a continuous granulate layer, which comprises:

relieving the granulates from foreign materials, bringing said granulates to a higher level than the base, adjusting the granulate flow rate, spreading the granulates to form said layer, moving said layer by gravity towards the base such that the layer is received by the base and thereby defines a layer fall location, coating during the layer fall, those granulates forming said layer with a material which causes said granulates to adhere to the base, charging the granulates and the coating material oppositely, moving the layer fall location relative to the base along a direction in parallel relationship with one base side, adjusting the relative movement speed of said location, and letting said material coating the granulates laid on the base, harden.

2. Lining method as defined in claim 1, which further comprises washing the granulates to effect the said relieving of same from foreign materials, and retaining said granulates in moist condition up to the time where the granulates are coated with said material.

3. Lining method as defined in claim 1, which further comprises coating with said material, the granulate layer laid down on said base, in a location adjacent to said layer fall location.

4. Lining method as defined in claim 1, which further comprises coating with said material, the base surface to be lined in a location adjacent to said layer fall location.

5. Lining method as defined in claim 1, which further comprises spreading over that base surface to be lined, at least one substance able to speed-up hardening of said material, in such a way as to load said surface with said substance before contacting said material.

6. Lining method as defined in claim 1, which further comprises projecting at least one finishing product such as steam, on the granulate layer laid over the base outside that area where the granulates are coated with said material, the steam-projection station being so selected as to have the steam reach the granulate layer before said material starts to harden.

7. Lining method as defined in claim 1, which further comprises when said base is pervious to said material, heating that base surface opposite to the surface which will receive the granulate layer, in that base zone contacting unhardened material.

8. Lining method as defined in claim 1, which further comprises using as said material, a water dispersion of a plasticizer-free acrylic polymer.

9. Equipment for lining a substantially plane quadrilateral-shaped base comprising:

means for relieving the granulates from foreign materials, means to raise said granulates to a higher level than the quadrilateral-shaped base, means for adjusting the granulate flow rate, means to spread said granulates and form therewith a continuous layer which is laid down by gravity on said base thereby defining a layer fall location where the granulates come into contact with the base, means to coat the granulates from said layer as they fall, with the material able to adhere the granulates to the base, means to move the layer fall location relative to the base along a direction in parallel relationship with one base side, and means to adjust the relative movement speed in said location, said means for adjusting the granulate flow rate, and the means to spread said granulates and form therefrom a continuous layer, comprise on the one hand a slanting table over the top surface of which the granulates move by gravity, which has in parallel relationship with the lower edge thereof, over the whole length and adjacent thereto, an element projecting relative to said top surface, the element cross-section being substantially in half-circle shape, and on the other hand a vibration generator which is connected to said table, means being provided on the one hand to vary the table slanting angle, and on the other hand to vary the frequency and amplitude of the vibrations being provided by said generator.

10. Equipment as defined in claim 9, which further comprises heating means so arranged as to speed-up hardening of said material coating those granulates which comprise the layer laid down on said base.

11. Equipment as defined in claim 9, in which the means for relieving the granulates from foreign materials comprise a washing enclosure at the outlet wherefrom heaters are arranged to dry partly at least, said granulates.

12. Equipment as defined in claim 11, in which said heaters for drying partly at least, said granulates, are comprised on the one hand, of banks so arranged as to generate an infrared radiation directed towards the top surface of said slanting table, and on the other hand of resistors associated to said table top surface.

13. Equipment as defined in claim 9, in which said means for coating with said material the granulates from said layer comprise at least one nozzle bank arranged in parallel relationship with the table lower edge and the length of which is substantially equal to that layer dimension as considered in parallel relationship with said edge, the nozzles being so directed as to spread said material to coat the layer granulates, from said lower table edge to the location where the layer falls on said base.

14. Equipment as defined in claim 13, which further comprises at least one fixed baffle arranged opposite at least one of said banks relative to the granulate layer moving from the table to the base.

15. Equipment as defined in claim 14, which further comprises a high-voltage source, the one source pole being connected to the table, while the other pole is connected to the nozzle banks and baffles.

16. Equipment as defined in claim 13, in which said nozzle bank lies between said table and base, said nozzles being moreover so directed as to spread said material over the base surface to be lines, in a location adjacent to the layer fall location.

17. Equipment as defined in claim 16, in which said nozzle bank is mounted on a device so arranged as to move said bank alternately between said table and base, along a direction substantially at right angle to said base.

18. Equipment as defined in claim 13, which further comprises in parallel relationship with said nozzle bank, means for distributing a product able to speed-up hardening of said material, said means being so arranged as to load with said product, the base surface to be lined before said surface contacting said material.

19. Equipment as defined in claim 13, in which said nozzle bank is arranged above the base lined with said granulate layer, the nozzles being moreover so directed as to spread said material over the granulate layer laid down on the base, in a location adjacent to where the layer falls on said base.

20. Equipment as defined in claim 9, in which said means for coating with said material said layer granulates, comprise at least two nozzle banks arranged in parallel relationship with the table lower edge, and the length of which substantially corresponds to the layer dimension as considered in parallel relationship with said edge, said bankds being arranged on either side of the granulate layer moving from the table to the base, each said banks lying between said granulate layer and a fixed baffle.

21. Equipment as defined in claim 9, which further comprises means to convey the base along a direction at right angle to the granulate layer moving by gravity from the table to the base.

22. Equipment as defined in claim 21, which further comprises at least one distributor fed with a finishing substance such as steam, arranged in parallel relationship with said banks, the nozzles from said steam distributor being so arranged as to distribute steam over the granulate layer laying on the base, upstream of that area where said material is spread over the granulates.

23. Equipment as defined in claim 21, in which said means for conveying the base from a roll thereof, comprise a shaft whereon said roll is mounted and which is rotated to unwind same, an endless mesh band which moves the base to line same, band whereto a constant-speed continuous movement is imparted in the same direction as the shaft driving the roll, and a storage device arranged between said latter roll and the endless band to store some length from the unwound base resulting from the differences between the constant linear speed of the endless band, and the varying unwinding speed of the roll, the storage device comprising upstream of the endless band, a set of two rollers wherebetween the base runs, the one said rollers being so driven by the band as to have the linear speed thereof be equal to the linear speed of said band.

24. Equipment as defined in claim 9, which further comprises a roller which is so arranged as to coat the base either with said material, or with the product able to speed-up hardening said material, said roller cooperating with the base before said base being coated with the granulate layer.

25. Equipment as defined in claim 9, which further comprises a levelling cylinder which is so arranged as to bear on the granulate layer when same has been laid down on the base.

26. Equipment as defined in claim 9, which further comprises an oven for speeding-up the hardening of said material, said oven advantageously comprising a preheating chamber to avoid heat shock.

27. Equipment as defined in claim 9, which further comprises when the base is pervious to said material, a blower blowing hot air on that base surface opposite that surface which will receive the granulate layer, in the base area contacting unhardened material.

* * * * *